US006033271A

United States Patent [19]

Schäfer

[11] Patent Number: 6,033,271

[45] Date of Patent: Mar. 7, 2000

[54] SHIP DRIVE WITH A DRIVING ENGINE AND A DIRECTLY DRIVEN PROPELLER SHAFT

[75] Inventor: Wilhelm F. Schäfer, Witten, Germany

[73] Assignee: A. Friedr. Flender AG, Bocholt, Germany

[21] Appl. No.: 09/051,446

[22] PCT Filed: Oct. 1, 1996

[86] PCT No.: PCT/DE96/01907

§ 371 Date: Apr. 21, 1998

§ 102(e) Date: Apr. 21, 1998

[87] PCT Pub. No.: WO97/13682

PCT Pub. Date: Apr. 17, 1997

[30] Foreign Application Priority Data

Oct. 4, 1995 [DE] Germany ..... 195 36 937
Jun. 10, 1996 [DE] Germany ..... 196 23 914

[51] Int. Cl.[7] ..... B63H 21/20; B63H 23/10; B63H 20/14; B63H 23/34; B60L 11/02

[52] U.S. Cl. ..... 440/3; 440/4; 440/6; 440/75; 440/83

[58] Field of Search ..... 440/49, 58, 64, 440/75, 83, 3, 4

[56] References Cited

U.S. PATENT DOCUMENTS 2,556,678 3/1951 Crafts ..... 192/114
3,930,379 1/1976 Hiersig et al. ..... 64/11
3,962,933 6/1976 Wedler ..... 74/665
4,406,633 9/1983 Hamm ..... 440/75
5,616,056 4/1997 Meissner ..... 440/3

OTHER PUBLICATIONS

Marine Engineers Review, pp. 35–36 XP 002028953 "Emergency propulsion availability exploiting the gensets and electric motor", Jun. 1993.

*Primary Examiner*—D. Glenn Dayoan
*Assistant Examiner*—Patrick Muldoon
*Attorney, Agent, or Firm*—Max Fogiel

[57] ABSTRACT

A ship propulsion system in which the ship's propeller is connected with its propeller shaft directly to a drive mechanism. A thrust bearing in the drive mechanism receives directly the thrust of the propeller shaft. An auxiliary drive with an electrical machine is operable selectively as a motor or as a generator, and a coupling is provided between the electrical machine and transmission linkage in the auxiliary drive. A gear on the transmission surrounds the propeller shaft, and a flexible coupling connects the transmission to the propeller shaft. Mounted on a separate section of the propeller shaft between the transmission and the drive mechanism, is a shiftable coupling which is free of play and transmits torque from the drive mechanism to the propeller shaft as well as the thrust of the propeller shaft. An auxiliary thrust bearing is connected to the shiftable coupling and is actuated when the ship is in auxiliary or emergency operation during which the propeller shaft has a reduced thrust.

10 Claims, 2 Drawing Sheets

SHIP DRIVE WITH A DRIVING ENGINE AND A DIRECTLY DRIVEN PROPELLER SHAFT

BACKGROUND OF THE INVENTION

The present invention concerns a ship-propulsion system comprising a drive mechanism and a shaft directly connected to it and provided with a propeller.

Ships propelled by systems with only one drive mechanism can be subjected to considerable hazard when the mechanism malfunctions or fails. In the worst cases, the ship can become unmaneuverable and even totally lost. The maneuverability of ships that carry hazardous or very environmentally deleterious goods must in particular be guaranteed in emergencies.

The simplest solution is to install an accessory drive mechanism in the propeller shaft. Such accessory drive mechanisms include a motor that drives the shaft or propeller by way of a transmission, and the shaft must be uncoupled from the defective main drive mechanism by a separating mechanism. The thrust provided by such accessory or emergency drive mechanisms for application to the hull of the ship is much weaker than that of a main drive mechanism.

Such a approach can be inferred from the Lohmann & Stolterfoht prospectus, FLESALUS RDE 75153, published December 1993 and describing a "flexible" emergency ship-propulsion system. A pneumatically powered cogged clutch separates both the drive mechanism and the propeller, neither of which is illustrated. The coupling simultaneously acts as a bearing in transmitting the propeller's thrust. There is a drawback to this approach, however, in that there is play in the clutch and the resulting vibrations are difficult to deal with. Another drawback is that the clutch and bearing together require a special base to introduce the forces into the hull.

Known from Swiss Patent 173 968 is a combination ship-propulsion system wherein for example a piston device and a turbine can be engaged with a propeller shaft. To prevent damage to the drive mechanism if the shaft suddenly stops, a safety-ensurance clutch between the transmission and the propeller entirely disengages the shaft form the rest of the mechanism when a specified angular momentum is exceeded.

SUMMARY OF THE INVENTION

The object of the present invention is accordingly a ship-propulsion system that has a drive mechanism and a directly driven propeller shaft and an accessory drive mechanism for auxiliary or emergency operation with a weaker propeller thrust that can be introduced into the hull without play on the part of the components of the separating mechanism, eliminating the need for a separate base.

The core of the present invention is the combination of an in-itself known non-play clutch (cf. L&S Mitteilung 84, September/1982) and a non-play auxiliary thrust bearing that can be engaged when the ship is in auxiliary or emergency operation. The auxiliary thrust bearing transmits the diminished propeller thrust to another thrust bearing accommodated in the drive mechanism. The clutch is preferably an in-itself known hydraulic conical bolt-actuated clutch. The auxiliary thrust bearing is specifically designed to prevent the clutch's components from being affected by the propeller thrust, ensuring non-play positioning of all parts.

The advantage of the present invention is that angular momentum is transmitted definitely independent of thrust, whereby in both cases the absolute freedom from play of the individual components is of primary significance due to the wide fluctuations in angular momentum and thrust typical of conventional drive mechanisms with two-stroke engines. Another advantage of the present invention is that, since the clutch does not require a separate base, both thrust bearings, the one in the drive mechanism and the auxiliary thrust bearing coupled to the clutch, cannot affect each other.

BRIEF DESCRIPTION OF THE DRAWINGS

One embodiment of the auxiliary thrust bearing in accordance with the present invention will now be specified with reference to the accompanying drawing, wherein.

DESCRIPTION OF THE PREFERRED EMBODIMENTS

Figure 1:
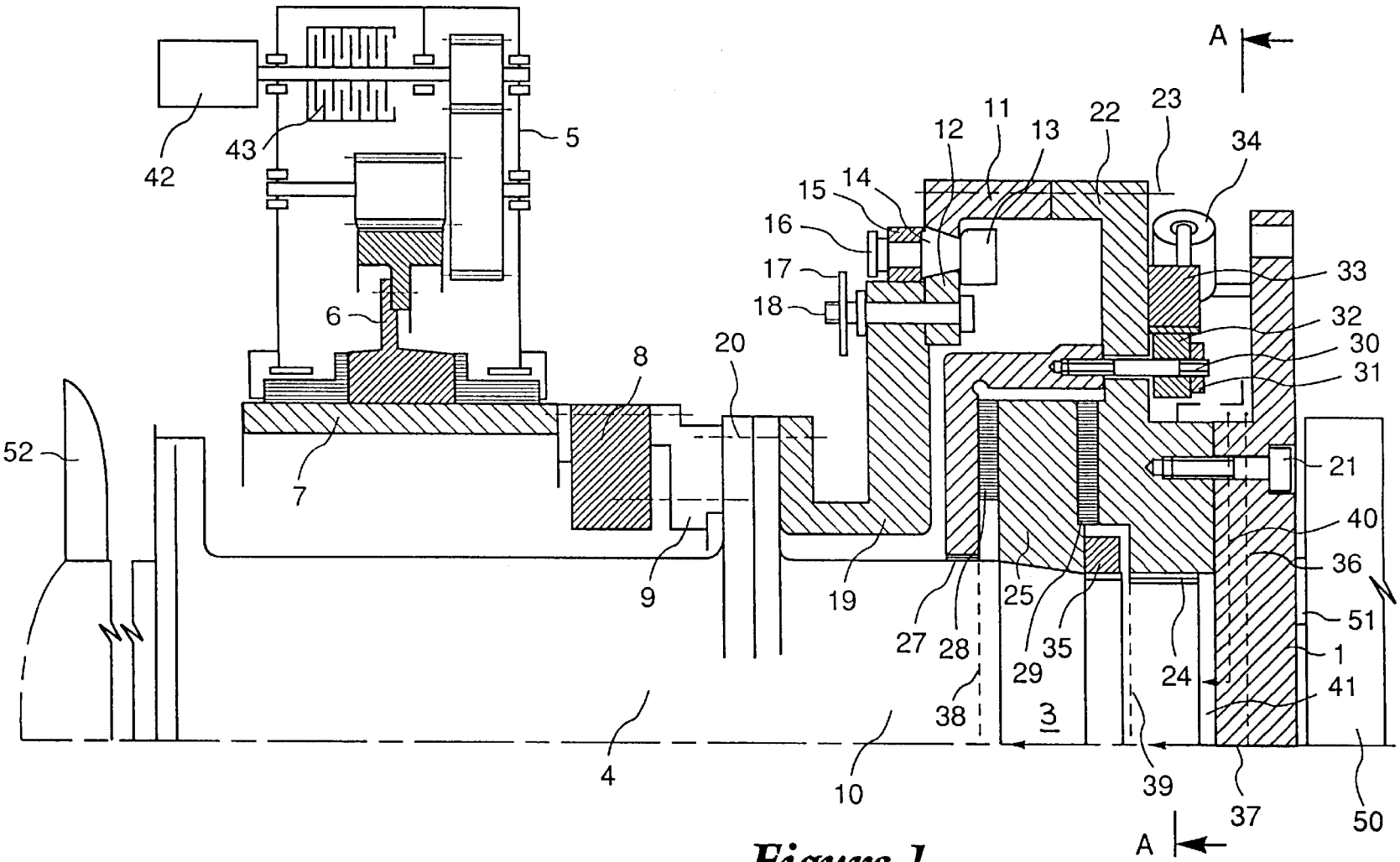
FIG. 1 is a longitudinal axial section through a ship-propulsion system in accordance with the present invention and FIG. 2 is a section along the line A—A in FIG. 1.

FIG. 1 is a longitudinal section along the axis of part of a ship-propulsion system in accordance with the present invention. A drive mechanism 50 with a thrust beating 51, usually a longitudinal rotary diesel, is connected to an integrated auxiliary thrust bearing 3 by a driving-end flange 1 and by a shifted non-play clutch 2, which will be further specified hereinafter and which is provided with an integrated auxiliary thrust bearing 3. The particular connection between intermediate propeller shaft 4 and the main propeller shaft with the propeller mounted on it is not illustrated. All that is essential is that the connection is a "direct" drive mechanism, whereby the particular desired propeller speed is attained by regulating the speed of the drive mechanism itself. There is accordingly no need for a transmission between this main drive mechanism and the propeller 52. An accessory drive mechanism ensures continued maneuverability of the ship in the event of failure on the part of the main drive mechanism. The accessory drive mechanism includes an electrical device 42 that can be operated as either a motor or as a generator as desired. Device 42 is connected to a transmission 5 by a clutch 43. The transmission 5 in the present embodiment is an intake transmission and has a large cogwheel 6 mounted on a sleeve 7 that surrounds intermediate propeller shaft 4. Transmission 5 is connected to intermediate propeller shaft 4 by a highly resilient clutch 8. Clutch 8 is connected to intermediate propeller shaft 4 by an annular flange 9. Shifted clutch 2 and auxiliary thrust bearing 3 are secured by a thrust shaft 10 accommodated between intermediate propeller shaft 4 and driving-end flange 1.

Shifted non-play clutch 2 is a conventional bolt-actuated clutch. It comprises an outer annular flange 11, an inner annular flange 12, an annular retaining flange 13 and conical bolts 14. A ring-securing flange 15 secures and positions conical bolts 14, which are forced against it by special nuts 16. How far shifted non-play clutch 2 can open is determined by a bolt 18 that is provided with a stop 17. Details of the hydraulically powered motion of conical bolts 14 have been excluded from the drawing as inessential to the present invention. The angular momentum of the engaged bolt-actuated clutch 2 is transmitted to thrust shaft 10 and intermediate propeller shaft 4 by a U-shaped cross-section flange 19 connected to shaft 10 by a threaded connection 20.

Figure 2:
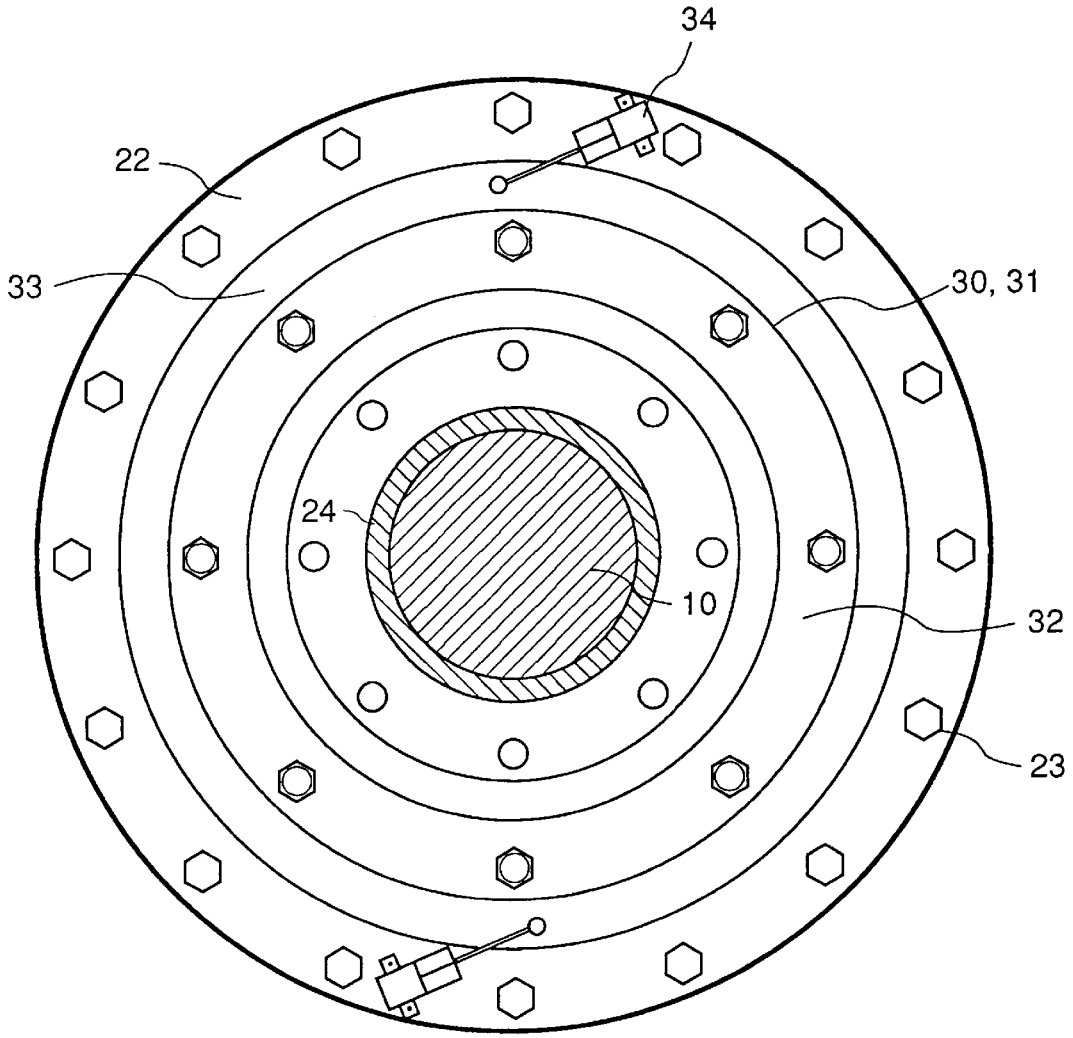

A non-play auxiliary thrust bearing 3 is in accordance with the present invention integrated into in-itself known bolt-actuated clutch 2. Non-play auxiliary thrust bearing 3 will now be specified in detail. The driving-end flange 1 on the drive mechanism 50 is fastened to an annular flange 22 by a threaded connection 21. Annular flange 22 is itself fastened to the aforesaid outer annular flange 11 on bolt-actuated clutch 2 by another threaded connection 23. The annular flange 22 on non-play auxiliary thrust bearing 3 rests against thrust shaft 10 by way of bearing 24. A tight collar 25 can rest against the inner surface of annular flange 22. Axial displacement is provided by one taper on thrust shaft 10 and another in collar 25. Collar 25 is axially positioned by a counternut 35 mounted on a threaded section of thrust shaft 10. Collar 25 is secured on the other side by a bent flange 26 that rests against thrust shaft 10 by way of a bearing 27. An annular disk 28 is accommodated between bent flange 26 and collar 25 and another annular disk 29 between collar 25 and annular flange 22. Annular disks 28 and 29 are provided with pressure blocks 53. Bent flange 26 is fastened to annular flange 22 by screws 30. This connected is secured by a nut 31. There is a pre-tensioning ring 32 between nut 31 and annular flange 22. Pre-tensioning ring 32 acts in conjunction with a counternut 33 that can be tensioned and released by an adjusting mechanism 34. Although adjusting mechanism 34 is not illustrated in FIG. 1, the detail in FIG. 2 represents one possible embodiment.

How bearings 24 and 27 are lubricated will now be specified. With bolt-actuated clutch 2 disengaged and driving-end flange 1 stationary, lubricant is introduced through a radial channel 36 in driving-end flange 1 to a bore 37 extending along the axis of thrust shaft 10 and thence through channels 38 and 39 that diverge radially out of the shaft to bearings 24 and 27. Driving-end flange 1 also contains another radial channel, channel 40, that opens into space 41 between it and thrust shaft 10. Fluid is pumped into space 41 to help separate non-play auxiliary thrust bearing 3.

I claim:

1. A ship propulsion system comprising: drive means; a propeller with a propeller shaft connected directly to said drive means; a thrust bearing in said drive means for receiving directly thrust of said propeller shaft; auxiliary drive means having an electrical machine operable selectively as a motor or as a generator, said electrical machine being operated when electrical power is produced aboard ship; coupling means connected between said electrical machine and transmission means in said auxiliary drive means; gear means on said transmission means and surrounding said propeller shaft; a flexible coupling connecting said transmission means to said propeller shaft; a shiftable coupling mounted on a separate section of said propeller shaft between said transmission means and said drive means; said shiftable coupling being free of play and transmitting torque from said drive means to said propeller shaft and the thrust of said propeller shaft; an auxiliary thrust bearing free of play and connected to said shiftable coupling, said auxiliary thrust bearing being actuated when the ship is in auxiliary or emergency operation; said propeller shaft having a reduced thrust in said auxiliary or emergency operation transmitted through said auxiliary thrust bearing to said thrust bearing in said drive means in the ship's hull, said auxiliary drive means being operated when said electrical machine comprises a supplemental drive after said electrical machine is switched over to motor operation and said drive means is separated from said propeller shaft by disengagement of said shiftable coupling and actuating said auxiliary thrust bearing integral with said shiftable coupling.

2. A ship propulsion system as defined in claim 1, including a first flange connected to said drive means and also connected to an annular disc-shaped second flange through a threaded first connection; a bent third flange connected to said second flange through a threaded second connection, said second flange being also connected to said shiftable coupling through a threaded third connection; a pre-tensioned ring in said threaded second connection and a counter-nut connected to said pre-tensioned ring; adjusting means for releasing and tensioning said pre-tensioned ring and said counter-nut; said second flange and said third flange being mounted on a separate section of said propeller shaft; a tensioned collar on said separate section of said propeller shaft and being pressable to said second flange and said third flange free of play; said tensioned collar having ring-shaped discs between said collar and said second flange and between said collar and said third flange; said auxiliary thrust bearing being formed free of play by said second flange and said third flange.

3. A ship propulsion system as defined in claim 2, wherein in normal ship operation said first flange is connected to said second flange and said second flange is connected to said shiftable coupling, whereby said shiftable coupling is actuated and said counter-nut is tensioned.

4. A ship propulsion system as defined in claim 2, wherein in forward ship drive and in auxiliary or emergency operation said tensioned collar operates together with said second flange through a ring-shaped disc having tensioned blocks for transmitting reduced thrust of the propeller shaft, whereby said shiftable coupling is disengaged and said counter-nut is released.

5. A ship propulsion system as defined in claim 2, wherein in backward ship drive and in auxiliary or emergency operation said tensioned collar operates together with said third flange through a ring-shaped disc having tensioned blocks for transmitting reduced thrust of the propeller shaft, whereby said shiftable coupling is disengaged and said counter-nut is released.

6. A ship propulsion system as defined in claim 2, including another counter-nut for positioning said tensioned collar.

7. A ship propulsion system as defined in claim 2, wherein said first flange has a radially running first channel and said separate section of said propeller shaft has a second channel in the shaft's center axis, said first channel being connected to said second channel, said second channel having radial branches running to bearings lubricated on said separate section of said propeller shaft through said first and second channels in disengaged shiftable coupling and stationary first flange.

8. A ship propulsion system as defined in claim 7, wherein said first flange has another radially running channel communicating with an intermediate chamber between said first flange and said separate section of said propeller shaft.

9. A ship propulsion system as defined in claim 2, including a bearing on said separate section of said propeller-shaft near said first flange comprising a shaft-centering bearing.

10. A ship propulsion system comprising: drive means; a propeller with a propeller shaft connected directly to said drive means; a thrust bearing in said drive means for receiving directly thrust of said propeller shaft; auxiliary drive means having an electrical machine operable selectively as a motor or as a generator, said electrical machine being operated when electrical power is produced aboard ship; coupling means connected between said electrical machine and transmission means in said auxiliary drive means; gear means on said transmission means and surrounding said propeller shaft; a flexible coupling connecting said transmission means to said propeller shaft; a shiftable coupling mounted on a separate section of said propeller shaft between said transmission means and said drive means; said shiftable coupling being free of play and transmitting torque from said drive means to said propeller shaft and the thrust of said propeller shaft; an auxiliary thrust bearing free of play and connected to said shiftable coupling, said auxiliary thrust bearing being actuated when the ship is in auxiliary or emergency operation; said propeller shaft having a reduced thrust in said auxiliary or emergency operation transmitted through said auxiliary thrust bearing to said thrust bearing in said drive means in the ship's hull, said auxiliary drive means being operated when said electrical machine comprises a supplemental drive after said electrical machine is switched over to motor operation and said drive means is separated from said propeller shaft by disengagement of said shiftable coupling and actuating said auxiliary thrust bearing integral with said shiftable coupling; a first flange connected to said drive means and also connected to an annular disc-shaped second flange through a threaded first connection; a bent third flange connected to said second flange through a threaded second connection, said second flange being also connected to said shiftable coupling through a threaded third connection; a pre-tensioned ring in said threaded second connection and a counter-nut connected to said pre-tensioned ring; adjusting means for releasing and tensioning said pre-tensioned ring and said counter-nut; said second flange and said third flange being mounted on a separate section of said propeller shaft; a tensioned collar on said separate section of said propeller shaft and being pressable to said second flange and said third flange free of play; said tensioned collar having ring-shaped discs between said collar and said second flange and between said collar and said third flange; said auxiliary thrust bearing being formed free of play by said second flange and said third flange, in normal ship operation said first flange is connected to said second flange and said second flange is connected to said shiftable coupling, whereby said shiftable coupling is actuated and said counter-nut is tensioned, in forward ship drive and in auxiliary or emergency operation said tensioned collar operates together with said second flange through a ring-shaped disc having tensioned blocks for transmitting reduced thrust of the propeller shaft, whereby said shiftable coupling is disengaged and said counter-nut is released, in backward ship drive and in auxiliary or emergency operation said tensioned collar operates together with said third flange through a ring-shaped disc having tensioned blocks for transmitting reduced thrust of the propeller shaft, whereby said shiftable coupling is disengaged and said counter-nut is released; another counter-nut for positioning said tensioned collar, said first flange having a radially running first channel and said separate section of said propeller shaft has a second channel in the shaft's center axis, said first channel being connected to said second channel, said second channel having radial branches running to bearings lubricated on said separate section of said propeller shaft through said first and second channels in disengaged shiftable coupling and stationary first flange; a bearing on said separate section of said propeller shaft near said first flange comprising a shaft-centering bearing; said first flange having another radially running channel communicating with an intermediate chamber between said first flange and said separate section of said propeller shaft.

* * * * *